United States Patent [19]

Baldwin et al.

[11] 3,975,936

[45] Aug. 24, 1976

[54] FORMING APPARATUS

[75] Inventors: Frederick M. Baldwin, Asheville; Stanley J. Noesen, Hendersonville, both of N.C.

[73] Assignee: General Electric Company, New York, N.Y.

[22] Filed: June 19, 1975

[21] Appl. No.: 588,403

[52] U.S. Cl. ..... 72/38; 72/56; 72/60; 72/344

[51] Int. Cl.[2] ..... B21B 9/00

[58] Field of Search ..... 72/38, 56, 60, 344, 72/427; 29/421 M, 421 E, 421 R; 240/103 R

[56] References Cited

UNITED STATES PATENTS

| | | | |
|---|---|---|---|
| 3,238,753 | 3/1966 | Benatar et al. | 72/56 |
| 3,581,541 | 6/1971 | Wildi | 72/56 |
| 3,646,792 | 3/1972 | Hertel et al. | 72/56 |

*Primary Examiner*—Carl E. Hall

*Attorney, Agent, or Firm*—Sidney Greenberg

[57] ABSTRACT

Apparatus for forming hollow metal articles such as aluminum reflectors for Luminaires. The apparatus comprises a convex forming punch movable into a complementary hollow magnetic forming coil device. The forming punch is mounted on a base having an annular slot opening at the periphery of the forming punch and being connected to passages in the base for quickly evacuating the air between the workpiece and the punch prior to the magnetic forming operation.

4 Claims, 7 Drawing Figures

FORMING APPARATUS

The present invention relates to forming apparatus and particularly concerns apparatus for forming hollow metal articles such as luminaire reflectors.

It is an object of the invention to provide forming apparatus of the above type, especially that used in conjunction with a high intensity electromagnetic forming device, having improved means for evacuating the air between the forming punch of such apparatus and the workpiece arranged thereon prior to the forming operation.

It is a particular object of the invention to provide air evacuation means for the described apparatus which quickly evacuates the air to a low pressure level.

Another object of the invention is to improve the appearance of a workpiece subjected to the forming operation in apparatus of the above type.

Still another object of the invention is to provide forming apparatus of the above type having means to facilitate removal of the formed workpiece from the forming punch.

Other objects and advantages will become apparent from the following description and the appended claims.

With the above objects in view, the present invention in one of its aspects relates to forming apparatus comprising, in combination, forming means comprising a convex forming punch having a base on the bottom thereof, annular wall means extending around the base and offset laterally beyond the bottom of the forming punch, the forming punch having an outer forming surface adapted to receive and form a hollow workpiece having a rim adapted to rest on the top of the annular wall means, the annular wall means being formed with an annular slot opening at the top thereof closely adjacent the forming surface of the forming punch, the base being formed with radial passages communicating with the annular slot, and evacuating means connected to the radial passages for evacuating the air in the space between the workpiece and the forming surface of the forming punch.

In one embodiment of the forming apparatus, the annular wall means is constituted by an annular member slidable axially relative to the base, whereby rapid evacuation of air from the space between the workpiece and the punch is enhanced and removal of the workpiece from the punch is facilitated.

The invention will be better understood from the following description taken in conjunction with the accompanying drawings, in which.

Figure 3:
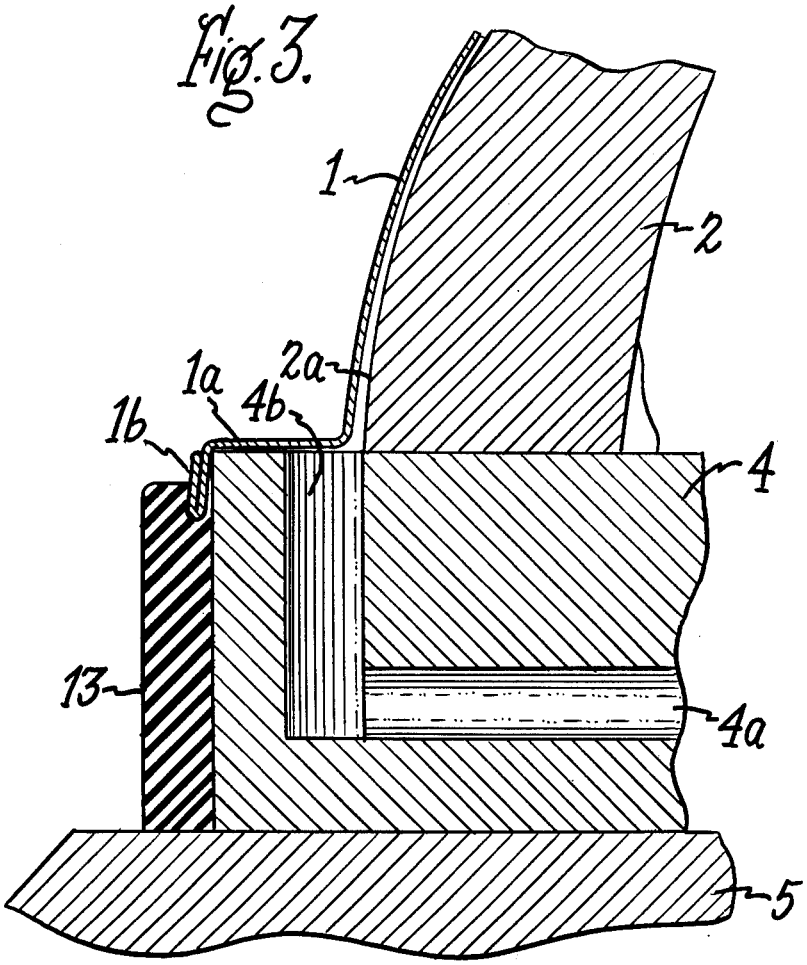
FIG. 3 is an enlarged detailed view in cross-section of a portion of the FIG. 1 apparatus.
Figure 3A:
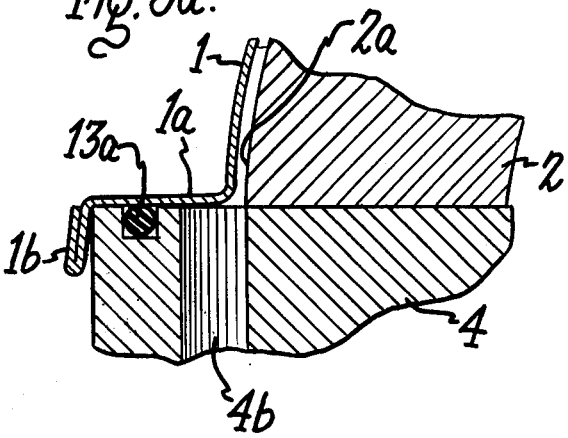
Figure 4A:
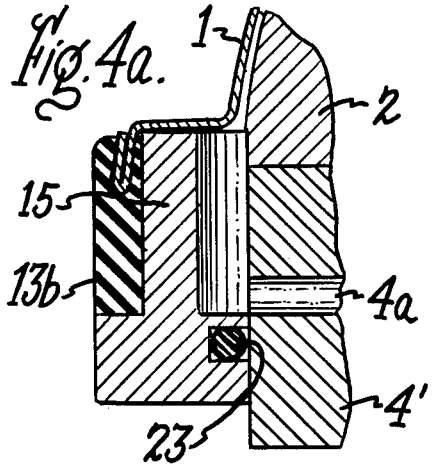
Figure 4:
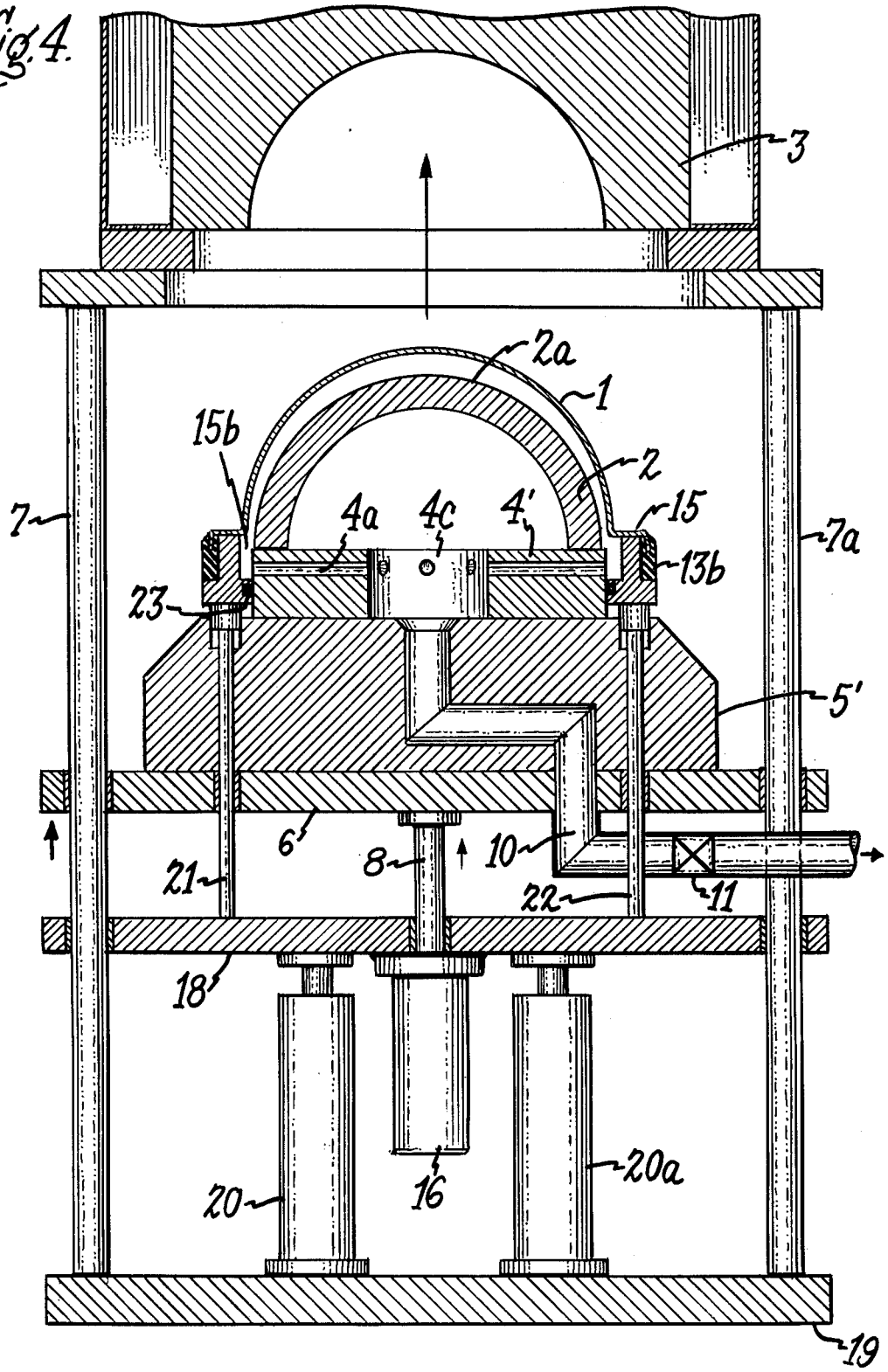
Figure 5:
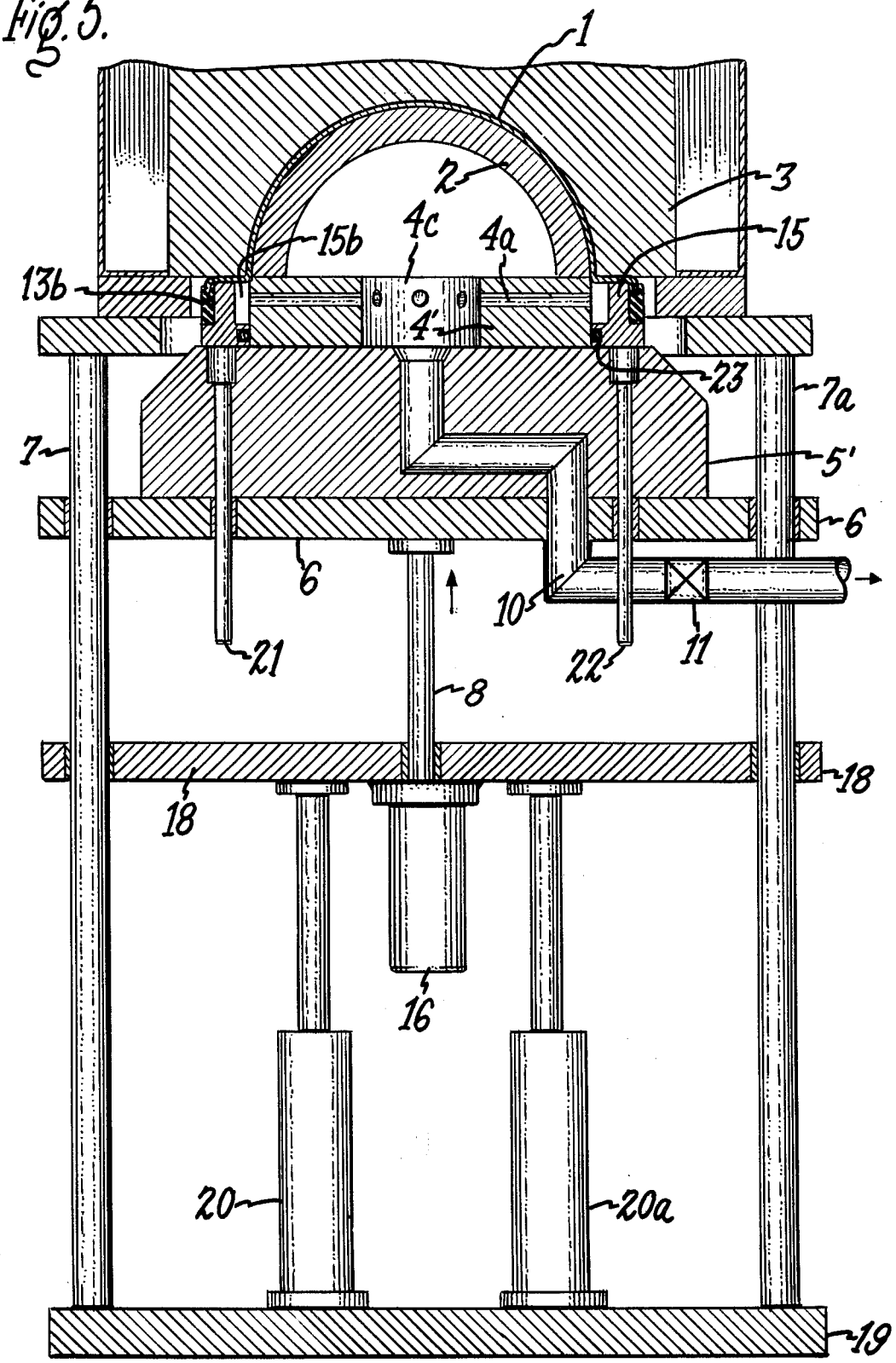

FIG. 3*a* shows a modification of the gasket arrangement shown in FIG. 3;

FIG. 4 is an elevational view, partly in section, of a different embodiment of the forming apparatus of the invention showing the parts at one stage of the operation of the apparatus;

FIG. 4*a* is an enlarged detail view in cross-section of a portion of the FIG. 4 apparatus; and FIG. 5 is a view of the FIG. 4 apparatus showing the parts at a different stage of operation.

Figure 1:
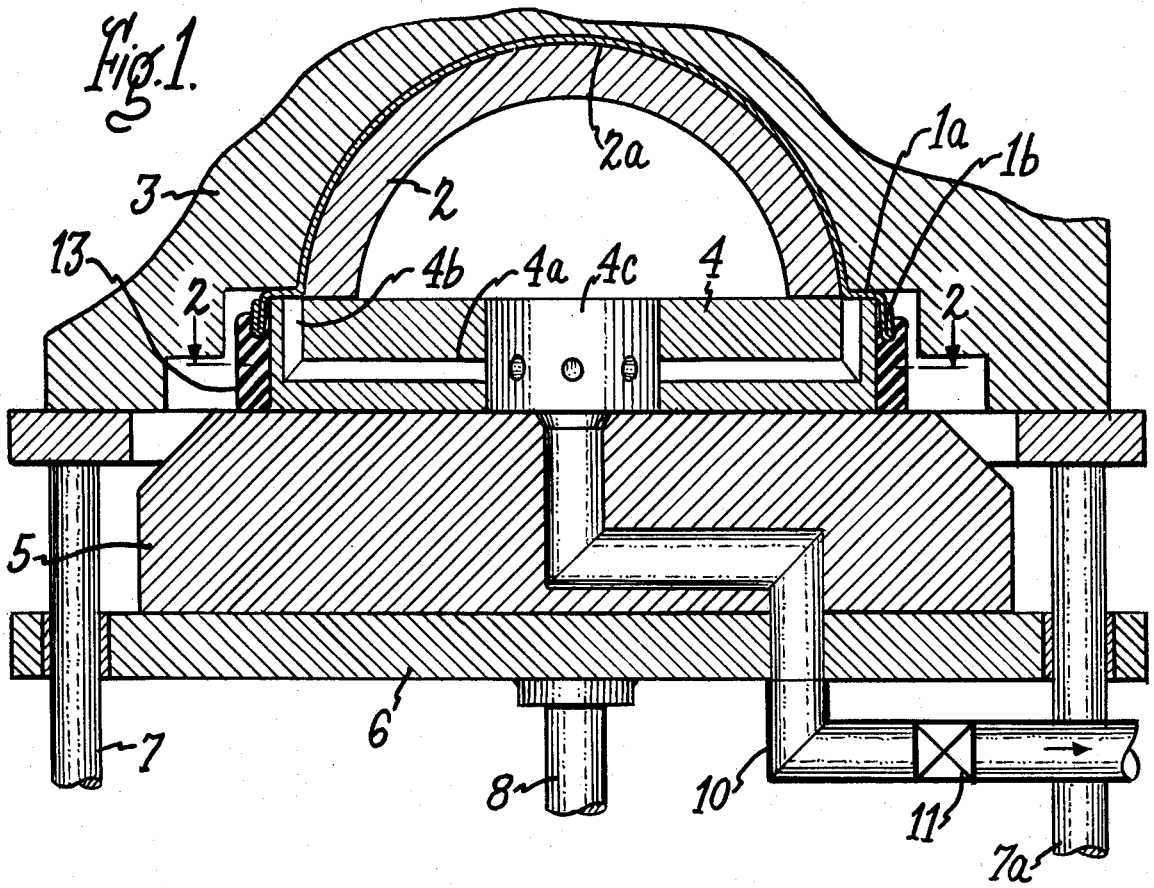
FIG. 1 is a view in cross-section of an embodiment of the forming apparatus of the invention.

Referring now to the drawings, and particularly to FIG. 1, there is shown a forming apparatus for shaping a dome-shaped reflector 1 of a type employed in luminaires, and on the surface of which light directing flutes or facets are to be formed by the disclosed apparatus. Such a reflector is shown, for example, in the U.S. Pat. No. to Osteen et al 3,662,165. The reflector, as seen in FIG. 1, has a rim portion surrounding its open bottom comprising a horizontal flange 1*a* and a depending skirt 1*b*.

The illustrated forming apparatus comprises a dome-shaped forming punch 2 having an outer forming surface 2*a* shaped to provide the desired configuration on reflector 1. The forming of the reflector is accomplished by placing the generally smooth-surfaced reflector on forming punch 2 and moving the latter into a position closely adjacent the magnetic forming coil device 3 having a complementary hollow cavity in which forming punch 2 is received, as seen in FIG. 1. The desired forming of reflector 1 is achieved by the application thereto of an intense magnetic field produced by discharge of electrical energy into the coils (not shown) of magnetic forming device 3. This effect and means for producing it are well known and are disclosed, for example, in the U.S. Pat. No. to Wildi 3,581,541. The force thus generated drives the workpiece against forming punch 2, thus forming the workpiece to the shape and surface finish of the forming punch. This action is instantaneous, and for this reason it is necessary to evacuate the air from the space between workpiece 1 and the surface of forming punch 2. Otherwise, the entrapped air cannot escape and is compressed with extremely high pressure and temperature by the advancing metallic article being accelerated by the magnetic field, thereby causing defects in the formed shape, such as bubbles and deformed surfaces.

In accordance with the invention, means are provided for very rapid evacuation of the air between the workpiece and the forming punch so as to avoid the above described problems. As seen in FIG. 1, forming punch 2 is mounted on base plate 4 which in turn is mounted on base block 5 which rests on support platen 6. To provide for movement of forming punch 2 into and out of magnetic forming device 3, platen 6 is slidable on tie rods 7, 7*a* and is moved by means of piston 8 of a suitable lift device (see FIG. 4). While only two tie rods are shown, it will be understood that typically four such tie rods at the corners of the apparatus would normally be employed.

Figure 2:
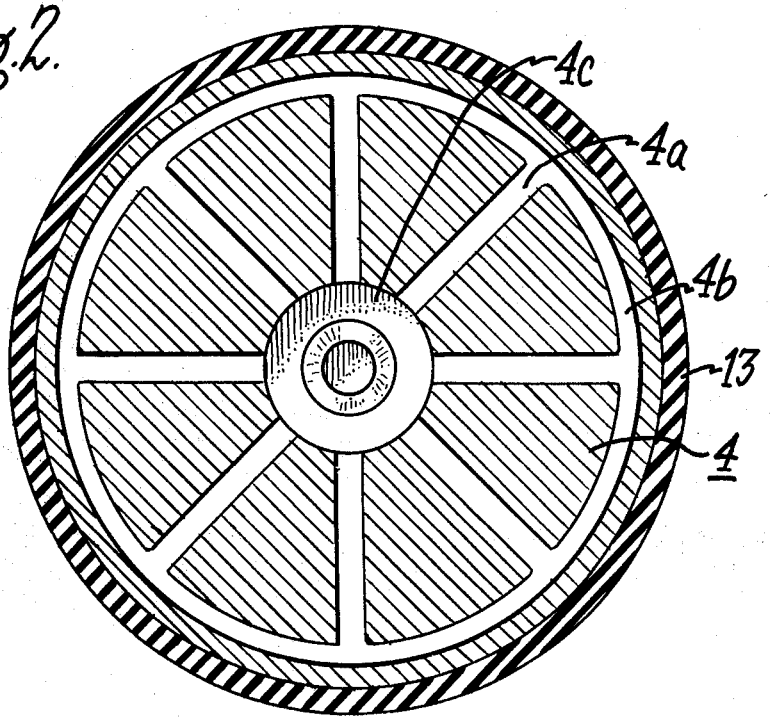
FIG. 2 is a view in horizontal section taken along the line 2—2 of FIG. 1.

Base plate 4 extends laterally beyond the bottom of punch 2 and is formed with radial air passages 4*a* (see FIG. 2) which communicate at their outer ends with annular slot 4*b* formed in the peripheral portion of base plate 4. The inner ends of passages 4*a* open into a central chamber 4*c*, to the bottom of which is connected a conduit 10 leading to a vacuum pump or the like (not shown) and having a suitable shut-off valve 11 therein. Annular slot 4*b* opens at the top of base plate 4 closely adjacent the outer surface of forming punch 2 (see FIG. 3) so as to communicate with the space between the latter surface and reflector 1. The parts are so dimensioned that flange 1*a* of the reflector rim rests on top of the peripheral portion of base plate 4 and reflector skirt portion 1*b* overlies the adjacent side of the base plate in sealing engagement with annular resilient gasket 13 surrounding base plate 4. With this arrangement, air can be quickly and thoroughly evacuated from the space between reflector 1 and the surface of forming punch 2 through annular slot 4*b*, radial passages 4*a* and conduit 10 just prior to energizing the magnetic forming device 3, and rapid production rates in the reflector forming operation can thereby be readily achieved while obtaining properly formed products.

An alternative arrangement of the sealing gasket is shown in FIG. 3*a*, wherein annular gasket or "O" ring 13*a* is located in a recess in the top of base plate 4 outward of annular slot 4*b*, and in this position provides a seal between reflector flange 1*a* and the top of base plate 4.

FIG. 4 shows a different embodiment of the invention in which an axially slidable annular wall member 15 formed with an annular recess 15*b* is arranged surrounding base plate 4' with recess 15*b* in communication with radial air passages 4*a*. FIG. 4 shows the arrangement of the parts of the forming apparatus during the initial stage with ring 15 in its upper position holding reflector 1 spaced somewhat away from the surface of forming punch 2. In this position of the apparatus, air is readily and quickly evacuated from the space between reflector 1 and forming punch 2, following which the forming punch is raised into operative position nested within magnetic forming device 3 and with ring 15 in its lowered position permitting reflector 1 to come into contact with forming punch 2, as shown in FIG. 5. In this position, the magnetic forming device 3 is energized to produce the desired configuration on reflector 1 as previously described.

The punch lifting operation is obtained by means of piston 8 operated by hydraulic cylinder 16 fixed to lower support platen 18 which, like upper support platen 6, is slidable on tie rods 7, 7*a* mounted on machine base 19. Lower platen 18 is moved by means of the pistons of hydraulic cylinders 20, 20*a* mounted on base 19. Push rods 21, 22 slidably mounted in base block 5' as shown operate to raise slidable ring 15 to the position shown in FIG. 4 when upper platen 16 and lower platen 18 are in their lowered positions as seen in FIG. 4, since in this position the lower ends of push rods 21, 22 rest on platen 18 while base block 5' with attached base plate 4' and forming punch 2 drops to its lowermost position. In the raised operative position of the punch assembly shown in FIG. 5, the enlarged tops of push rods 21, 22 drop into complementary openings in the upper surface of base block 5', allowing ring 15 to drop to its lower position to permit reflector 1 to come into engagement with forming punch 2 preparatory to the forming operation.

In the lifting operation, with the parts in the position shown in FIG. 4, cylinders 20, 20*a* raise lower platen 18 to its uppermost position, and then central cylinder 8 lifts upper platen 6 to its uppermost position as shown in FIG. 5.

A peripheral gasket 13*b* (see FIG. 4*a*) is arranged surrounding slidable ring 15 for sealing engagement with the skirt portion of reflector 1 similarly to the arrangement shown in FIGS. 1 and 3. Preferably a resilient "O" ring 23 is suitably arranged in a recess in the lower inside surface of slidable ring 15 to provide an air tight seal between the latter member and the adjacent surface of base plate 4' along which it slides.

The arrangement and operation of the apparatus of FIGS. 4 and 5 are such that in the pre-forming position shown in FIG. 4, reflector 1 is initially held spaced away from the forming surface of punch 2 so as to facilitate evacuation of the air therebetween. When this space is evacuated and the punch assembly is raised toward magnetic forming device 3, push rods 21, 22 drop down and permit slidable ring 15 to seat itself on base block 5' (see FIG. 5), bringing reflector 1 into proper relationship with forming punch 2 for the magnetic forming operation. Following the forming operation, the process is reversed, whereby punch 2 is lowered from out of the cavity of magnetic forming device 3, and thereafter sliding ring 15 is lifted by action of push rods 21, 22 when the latter come into contact with lower platen 18 (see FIG. 4), thereby stripping the formed reflector from the surface of forming punch 2. As will be understood, the vacuum is released and atmospheric pressure is restored to the air passages prior to stripping of the reflector from forming punch 2.

Due to the absence of air passage holes in the forming punch, such as employed in known types of forming devices, there is avoided the problem of spalling of the forming punch surface in the area where such holes are provided, as well as the undesirable marking of the reflector surface due to such holes and spalling. Furthermore, the higher vacuum made possible by the described arrangement results in a smoother reflector finish and a surface free of defects attendant on trapped air bubbles.

While the present invention has been described with reference to particular embodiments thereof, if will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. Forming apparatus comprising, in combination, forming means comprising a convex forming punch having a base on the bottom thereof, annular wall means extending around said base and offset laterally beyond the bottom of said forming punch, said forming punch having an outer forming surface adapted to receive and form a hollow workpiece having a rim adapted to rest on the top of said annular wall means, said annular wall means formed with an annular slot opening at the top thereof closely adjacent said forming surface of said forming punch, said base formed with radial passages communicating with said annular slot, and evacuating means connected to said radial passages for evacuating the air in the space between the workpiece and said forming surface of said forming punch, said annular wall means comprising an annular member axially slideable relative to said base.

2. Apparatus as defined in claim 1, including means for upwardly moving said annular member relative to said base for spacing the workpiece from said forming surface of said forming punch.

3. Apparatus as defined in claim 1, a pressure-producing forming device complementary to said forming punch arranged adjacent to said forming punch and coacting with the same for forming said workpiece, and lifting means for moving said forming means toward said complementary forming device and into operative relation thereto.

4. Apparatus as defined in claim 3, said lifting means comprising a first movable support holding said forming means, a second movable support arranged below said first movable support, first and second raising means for respectively lifting said first and second movable supports, and elongated means engageable at opposite ends with said slidable annular member and said second movable support for raising and lowering said annular member relative to said base.

* * * * *